US009486032B2

(12) United States Patent
Morris Thill

(10) Patent No.: US 9,486,032 B2
(45) Date of Patent: Nov. 8, 2016

(54) SHOES WITH INTERCHANGEABLE HEELS

(71) Applicant: Kimberly Morris Thill, Kent, WA (US)

(72) Inventor: Kimberly Morris Thill, Kent, WA (US)

( * ) Notice: Subject to any disclaimer, the term of this patent is extended or adjusted under 35 U.S.C. 154(b) by 595 days.

(21) Appl. No.: 13/841,096

(22) Filed: Mar. 15, 2013

(65) Prior Publication Data

US 2014/0259777 A1 Sep. 18, 2014

(51) Int. Cl.

| | |
|---|---|
| ***A43B 3/24*** | (2006.01) |
| ***A43B 13/34*** | (2006.01) |
| ***A43B 21/40*** | (2006.01) |
| ***A43B 21/42*** | (2006.01) |

(52) U.S. Cl.

CPC ..... *A43B 3/246* (2013.01); *A43B 13/34* (2013.01); *A43B 21/40* (2013.01); *A43B 21/42* (2013.01)

(58) Field of Classification Search

CPC ..... A43B 3/244; A43B 3/246; A43B 3/34; A43B 21/36; A43B 21/39; A43B 21/40; A43B 21/42; A43B 13/34

USPC ..... 36/15, 42, 100

See application file for complete search history.

(56) References Cited

U.S. PATENT DOCUMENTS

| | | | | |
|---|---|---|---|---|
| 368,676 | A | | 8/1887 | Marquette |
| 1,148,363 | A | | 7/1915 | Doody |
| 1,829,252 | A | | 10/1931 | Zubia |
| 1,994,508 | A | | 3/1935 | Filippelli |
| 2,137,816 | A | | 11/1938 | Sulllivan |
| 2,431,868 | A | | 12/1947 | Gilmour |
| 2,497,175 | A | | 2/1950 | Mantos |
| 2,556,842 | A | | 6/1951 | Gilmour |
| 2,582,551 | A | | 1/1952 | Malherbe |
| 2,795,867 | A | | 6/1957 | Zuckerman |
| 3,041,747 | A | | 7/1962 | Pfeil |
| 3,159,928 | A | | 12/1964 | Clark |
| 3,646,497 | A | * | 2/1972 | Gillikin ..... 36/58.5 |
| 4,363,177 | A | | 12/1982 | Boros |
| 4,610,100 | A | | 9/1986 | Rhodes |
| 5,025,574 | A | | 6/1991 | Lasher, III |
| 5,058,290 | A | * | 10/1991 | Koehl et al. ..... 36/42 |
| 5,373,649 | A | * | 12/1994 | Choi ..... 36/42 |
| 5,456,026 | A | | 10/1995 | Lewis |

(Continued)

OTHER PUBLICATIONS http://getsomehairapy.wordpress.com/2008/05/05/convertible-heel-shoes-geardiary/ Convertible heel shoes—Gear Diary, May 5, 2008, Camileon Heels: Exercising a Woman's Perogative to Change Her Mind (1 page).

(Continued)

*Primary Examiner* — Khoa Huynh
*Assistant Examiner* — Sharon M Prange
(74) *Attorney, Agent, or Firm* — R. Reams Goodloe, Jr.

(57) ABSTRACT

Shoes with interchangeable heels. The assembly includes a sole having a toe end and a heel end. At the heel end, a heel attachment slide capture feature is provided. The heel attachment slide capture feature includes opposing first and second wedge portions forming a partial V-shaped passageway therebetween. The partial V-shaped passageway may decrease in width from the heel end toward the toe end. First and second heels are provided, each having a heel body, an upper end, and a lower end, and a locking slide portion sized and shaped complementary to the slide capture feature, for secure engagement therewith. The locking slide portion may further includes a nose portion having a detent, configured for use with a quick disconnect latch to provide releasable locking engagement between the sole and a heel of selected height, such as a high heel, low heel, or medium height heel.

30 Claims, 4 Drawing Sheets

(56) References Cited

U.S. PATENT DOCUMENTS

| | | | | |
|---|---|---|---|---|
| 5,519,950 | A * | 5/1996 | Wang | 36/42 |
| 5,675,916 | A | 10/1997 | Lewis | |
| 5,692,322 | A | 12/1997 | Lombardino | |
| 5,782,015 | A | 7/1998 | Dananberg | |
| 5,953,836 | A | 9/1999 | Watt et al. | |
| 6,718,658 | B2 | 4/2004 | Karasawa | |
| 6,785,987 | B2 | 9/2004 | Bucalo et al. | |
| 7,059,068 | B2 | 6/2006 | Magallanes et al. | |
| 7,185,448 | B2 | 3/2007 | Schupbach | |
| 7,210,251 | B1 | 5/2007 | Rolle | |
| 7,272,899 | B1 | 9/2007 | Marak | |
| 7,578,075 | B1 | 8/2009 | Kemp | |
| 7,827,707 | B2 | 11/2010 | Davis | |
| 8,046,936 | B1 | 11/2011 | Simon | |
| 8,112,908 | B2 | 2/2012 | Visser | |
| 8,201,347 | B2 | 6/2012 | Garza | |
| 2001/0052195 | A1* | 12/2001 | Blakey | 36/100 |
| 2003/0154629 | A1 | 8/2003 | Goodloe | |
| 2007/0011909 | A1 | 1/2007 | Palmeri, III | |
| 2007/0234595 | A1 | 10/2007 | Davis | |
| 2011/0179670 | A1* | 7/2011 | Lepour | 36/42 |
| 2011/0197474 | A1* | 8/2011 | Mahmoud | 36/100 |

OTHER PUBLICATIONS www.akastatistic.org/mediawiki/images/4/4b/141_Proj_1.ppt Convertible Shoe Presentation & Evaluation—They're Not Your Mother's High Heels, Lauren Baechle, Stephanie Brown and Deb Shearer. (17 pages).

http://www.geardiary.com/2008/04/30/camileon-heels-exercising-a-womans-perogative-to-change-her-mind/ Posted on Apr. 30, 2008 by Judie Lipsett Stanford (6 pages).

* cited by examiner

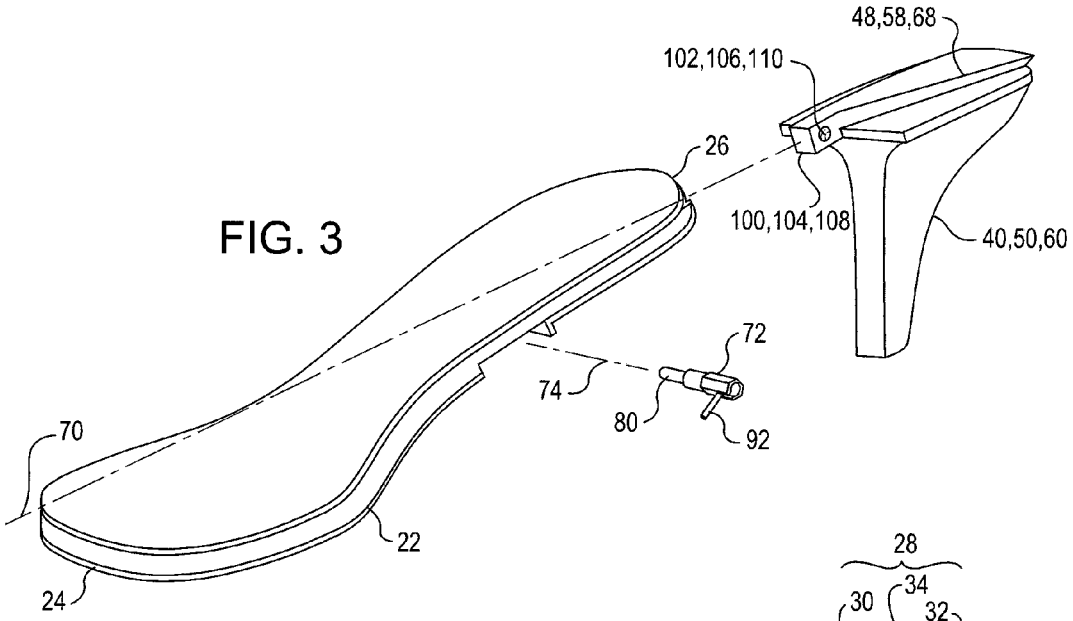
FIG. 3
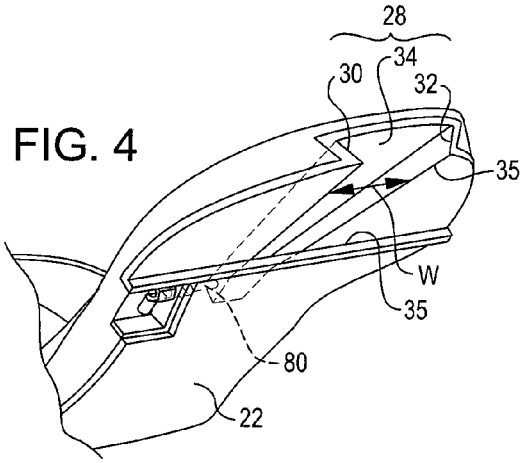
FIG. 4
FIG. 5
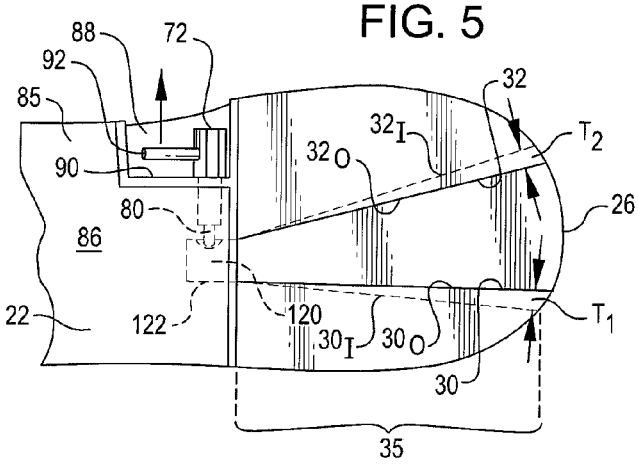

SHOES WITH INTERCHANGEABLE HEELS

STATEMENT OF GOVERNMENT INTEREST

Not Applicable.

COPYRIGHT RIGHTS IN THE DRAWING

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever.

RELATED PATENT APPLICATIONS

None.

TECHNICAL FIELD

This application relates to shoes, and in an embodiment, to women's shows which are configured use of the same upper portion with alternate height heels.

BACKGROUND

A wide variety of shoe designs have been heretofore proposed with detachable heels. However, in so far as I am aware, the previously available mechanisms for securing alternate heels to the sole of a shoe have been rather cumbersome. Thus, there remains a need to provide a simple, easily hand manipulated design to quickly and easily remove a currently attached heel and to replace it with another heel. It would be desirable to provide a suitable releasably locking configuration that would enable individuals to quickly and easily remove existing heels, and attach new heels, to each one of a pair of shoes.

SUMMARY

A novel shoe assembly with an interchangeable heel apparatus has been developed, that, in various embodiments, greatly eases the task of removing existing heels and attaching new heels to each one of a pair of shoes. In an embodiment, the shoe includes a sole and an upper foot engaging portion. The sole portion has a heel end and a toe end, and at the heel end, a heel attachment slide capture feature. The heel attachment slide capture feature includes opposing first and second wedge portions that form a partial V-shaped passageway therebetween. The partial V-shaped passageway is of decreasing width from the heel end toward the toe end.

Heel types may be provided in many shapes and sizes. In any event, a first heel is provided, having a first vertical height. The first heel has a first heel body with a first upper end and a first lower end, and a first ground engaging surface located at the first lower end. A first locking slide portion is sized and shaped complementary to the slide capture feature on the sole, for secure engagement therewith. In an embodiment, the first locking slide portion may be configured as a first sliding dove tail joint portion.

A second heel is provided, having a second vertical height. The second heel has a second heel body with a second upper end and a second lower end, and a second ground engaging surface located at the second lower end. A second locking slide portion is sized and shaped complementary to the slide capture feature on the sole, for secure engagement therewith. In an embodiment, the second locking slide portion may be configured as a second sliding dove tail joint portion.

A further embodiment may include yet a third heel, having a third vertical height. The third heel has a third heel body with a third upper end and a third lower end, and a third ground engaging surface located at the third lower end. A third locking slide portion is sized and shaped complementary to the slide capture feature on the sole, for secure engagement therewith. In an embodiment, the third locking slide portion may be configured as a third sliding dove tail joint portion.

A quick disconnect latch configured to provide releasable locking engagement between said sole and the first heel, or the second heel, or the third heel, is provided. In an embodiment, the quick disconnect latch may be in, or associated with, the sole portion.

In an embodiment, an apparatus for providing an interchangeable shoe assembly may include a heel attachment slide capture feature on the sole that is configured as a sliding dove tail joint portion.

BRIEF DESCRIPTION OF THE DRAWING

A novel shoe assembly with apparatus for interchangeable heel portions will be described by way of exemplary embodiments, using for illustration the accompanying drawing in which like reference numerals denote like elements, and in which:

FIG. 3 is a perspective view of a sole, a heel, and a quick release latch, showing where the heel and the latch may, in an embodiment, be located.

FIG. 4 provides a perspective view of the heel end of a sole, showing the heel attachment slide capture feature in the sole, which in an embodiment may be provided by opposing first and second wedge portions forming a partial V-shaped passageway therebetween, with the partial V-shaped passageway decreasing in width from said heel end toward said toe end of the sole.

FIG. 5 provides a bottom view of a sole, without a heel attached, showing an embodiment for a right hand shoe wherein the quick release latch is oriented to be accessible on the interior, or left side, of the right hand shoe, and also showing in hidden lines the location of a locking pin in the quick release latch in a position as if it were locking with a nose piece on a heel for locking engagement with the sole; it can be appreciated in this view in an embodiment, an exemplary locking pin may engage a detent in the nose piece, to secure the heel to the sole.

Figure 1:
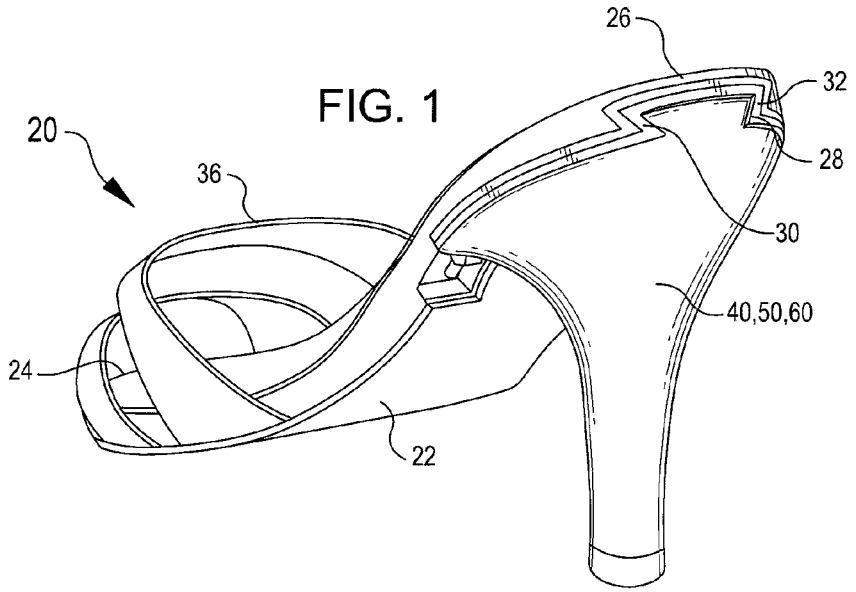
FIG. 1 is a perspective view of an embodiment for a shoe with interchangeable heels, in which interlocking dove tail joint portions are illustrated from the rear.
Figure 2:
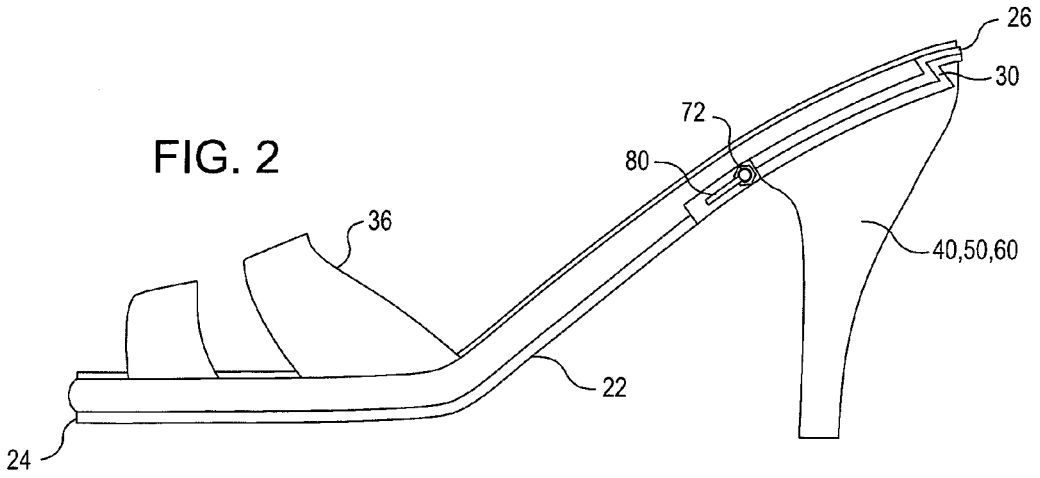
FIG. 2 is a side view of an embodiment for a shoe including apparatus that provides for interchangeable heels, showing the use of a high heel, where the high heel is releaseably affixed to the sole; an embodiment for a quick release latch is seen, which in an embodiment may be accessible from the inner side of a sole.

The foregoing figures, being merely exemplary, contain various elements that may be present or omitted from interchangeable heel designs for a shoe assembly utilizing the principles taught herein, or that may be implemented in various embodiments for such interchangeable heel designs for shoes. Other variations in quick release latch designs or to the interlocking slide designs may use slightly different mechanical structures, or different mechanical strengthening arrangements, or wedge upper or lower surface shapes on the shoe sole and on various heels, yet employ the principles described herein or depicted in the drawing figures provided. An attempt has been made to show the figures in a way that illustrates at least those elements that are significant for an understanding of an exemplary shoe assembly designs with interchangeable heels. Such details may be useful for providing a variable heel height shoe, and for facilitating a quick and easy method for changing heels on shoes.

It should be understood that various features may be utilized in accord with the teachings hereof, as may be useful in different embodiments as necessary or useful for various sizes and shapes of shoes and heel heights, depending upon the conditions of service, type of shoe on which the configuration may be used, or as to the orientation or to the resistance of releasable latch springs, and other variables, yet be provided within the scope and coverage of the teachings herein as defined by the claims set forth herein below.

DETAILED DESCRIPTION

Attention is directed to FIG. 1, where an embodiment for an interchangeable shoe assembly 20 is illustrated. The shoe assembly 20 includes a sole 22, having a toe end 24 and a heel end 26. At the heel end 26, a heel attachment slide capture feature 28 is provided. In an embodiment, the heel attachment slide capture feature 28 may further include opposing first 30 and second 32 wedge portions forming a partial V-shaped passageway 34 therebetween (see FIG. 4). As also better seen in FIGS. 5 and 6, the heel attachment slide capture feature 28 on the sole 22 may be provided as a base sliding dove tail joint portion 35.

As better seen in FIG. 4, the partial V-shaped passageway 34 at least in part decreases in width W from the heel end 26 toward the toe end 24. In various embodiments, an upper foot engaging portion 36 may be provided.

Figure 13:
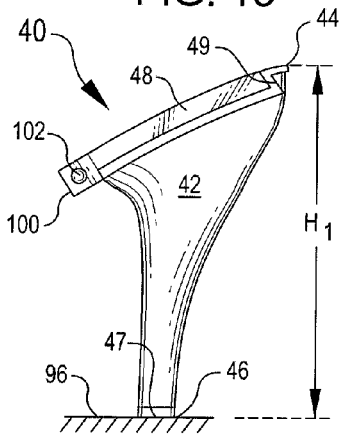
FIG. 13 is a side view of a first heel of height $H_1$, such as a high heel height (although it must be recognized that heel types may be provided in many shapes and sizes), and configured for interchangeable locking engagement with a sole configured to accept the locking structure as described herein.

As seen in FIGS. 1 and 13, first heel 40 may be provided. The first heel 40 may include a first heel body 42 having a first upper end 44 and a first lower end 46. A first ground engaging surface 47 may be located at the first lower end 46. A first locking slide portion 48 sized and shaped complementary to the slide capture feature 28 is provided, for secure mating engagement with the slide capture feature 28. 5. In an embodiment, the first locking slide portion 48 may be provided as a first sliding dove tail joint portion 49.

Figure 14:
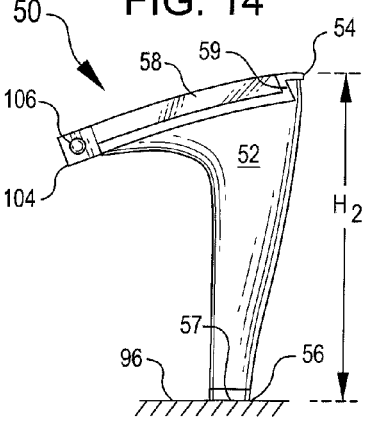
FIG. 14 is a side view of a second heel of height $H_2$, such as a medium heel height, and configured for interchangeable locking engagement with a sole configured to accept the locking structure as described herein.

As seen in FIG. 14, a second heel 50 may be provided. The second heel 50 may include a second heel body 52 having a second upper end 54 and a second lower end 56. A second ground engaging surface 57 may be located at the second lower end 56. A second locking slide portion 58, sized and shaped complementary to the slide capture feature 28 is provided, for secure mating engagement with the slide capture feature 28. In an embodiment, the second locking slide portion 58 may be provided as a second sliding dove tail joint portion 59.

Figure 15:
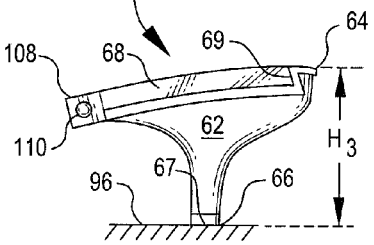
FIG. 15 is a side view of a third heel of height $H_3$, such as a low heel height, and configured for interchangeable locking engagement with a sole configured to accept the locking structure as described herein.

As seen in FIG. 15, a third heel 60 may be provided. The third heel 60 may include a third heel body 62 having a third upper end 64 and a third lower end 66. A third ground engaging surface 67 may be located at the third lower end 66. A third locking slide portion sized 68, sized and shaped complementary to the slide capture feature 28 is provided, for secure mating engagement with the slide capture feature 28. In an embodiment, the first locking slide portion 68 may be provided as a third sliding dove tail joint portion 69.

Turning now to FIG. 3, the sole 22 is shown oriented along a longitudinal axis indicated by broken line 70, substantially extending between the heel end 26 and the toe end 24. As indicated in FIG. 3, a quick disconnect latch 72 may be provided. In an embodiment, the quick disconnect latch 72 may be oriented substantially transverse (as indicated by broken line 74) to the longitudinal axis 70. The quick disconnect latch 72 provides releasable locking engagement between the sole 22 and a first heel 40, or a second heel 50, or a third heel 60, or other heels of similar configuration.

Figure 6:
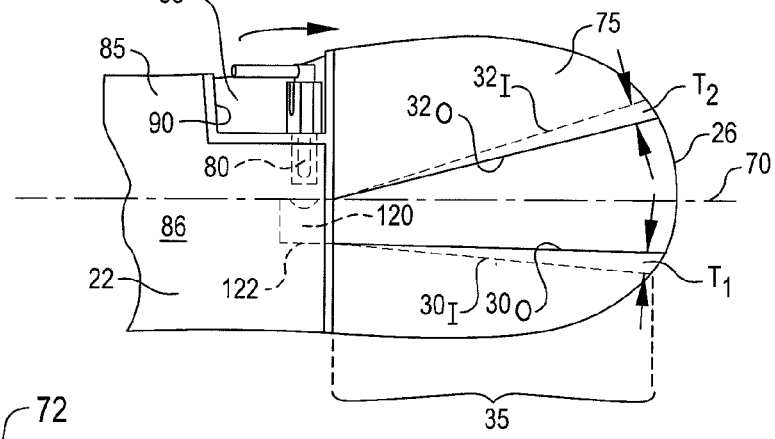
FIG. 6 provides a bottom view of a sole, also without a heel attached, showing an embodiment for a right hand shoe wherein the quick release latch is oriented to be accessible on the interior, or left side, of the right hand shoe, and also showing in hidden lines the location of a locking pin in the quick release latch in a position as if it were not locking a nose piece on a heel to the sole.

As seen in FIG. 6, a sole 22 having a longitudinal axis 70 may be provided in a configuration wherein at least one of the opposing first 30 and second 32 wedge portions is oriented substantially parallel to the longitudinal axis 70. As indicated in FIG. 6, when looking at the bottom 75 of a right hand sole 22, a first wedge portion 30 may be provided oriented substantially parallel to the longitudinal axis 70. As also seen in FIGS. 5 and 6, in an embodiment the depth T of a first wedge portion 30 or second wedge portion 32 may be provided in a configuration in which first width $T_1$ and second with $T_2$ that becomes narrower and narrower as distance increases from the heel end 26 of sole 22. For example, see FIG. 6, which shows the first width $T_1$ between an outer portion $\mathbf{30}_O$ and an inner portion $\mathbf{30}_I$ of the first wedge portion 30. Likewise, see in FIG. 6 the second width $T_2$ between an outer portion $\mathbf{32}_0$ and inner portion $\mathbf{32}_I$ of second wedge portion 32. Further, note by reference to FIG. 11, that the inner portion $\mathbf{30}_I$ of first wedge portion 30 will engage the first upper edge $\mathbf{48}_{EU1}$ (or analogous first upper edge $\mathbf{58}_{EU1}$ or $\mathbf{68}_{EU1}$ in other heel embodiments). Likewise, the inner portion $\mathbf{32}_I$ of second wedge portion 32 will engage the second upper edge $\mathbf{48}_{EU2}$ (or analogous second upper edge $\mathbf{58}_{EU2}$ or $\mathbf{68}_{EU2}$ in other heel embodiments). Similarly, note by reference to FIG. 11, that the outer portion $\mathbf{30}_o$ of first wedge portion 30 will engage the first lower edge $\mathbf{48}_{EL1}$ (or analogous first lower edge $\mathbf{58}_{EL1}$ or $\mathbf{68}_{EL1}$ in other heel embodiments). Likewise, the outer portion $\mathbf{32}_O$ of second wedge portion 32 will engage the second lower edge $\mathbf{48}_{EL2}$ (or analogous second lower edge $\mathbf{58}_{EL2}$ or $\mathbf{68}_{EL2}$ in other heel embodiments).

Figure 7:
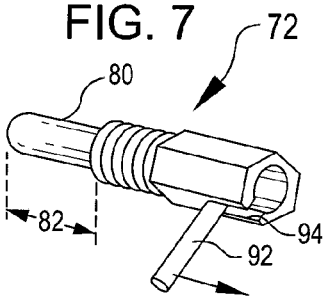
FIG. 7 provides a perspective view of an embodiment for a quick release latch, shown in a locking position, with locking pin extended for engagement with a locking feature such as a detent in a nose piece of a selected heel.
Figure 8:
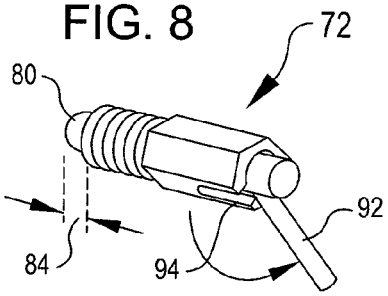
FIG. 8 provides a perspective view of an embodiment for a quick release latch, shown in an unlocked position, with the locking pin retracted, for disengagement from a locking feature such as a detent in a nose piece of a selected heel.

As further seen in FIGS. 7 and 8, in an embodiment, the quick disconnect latch 72 may include an extendible locking pin 80. The locking pin 80 is shown in an extended, locking position 82 in FIG. 7, and in a retracted, heel change position 84 in FIG. 8. The quick disconnect latch 72 is securely affixed to sole 22. In an embodiment, as seen in FIG. 5 the lower side 85 of sole 22 may include a built up portion 86 and a handle access portion 88, defined by sidewalls 90. In an embodiment, the quick disconnect latch 72 may be provided as a hand retractable spring plunger. Suitable hand retractable spring plungers may be obtained from J. W. Winco, Inc., located at 2815 South Calhoun Road, New Berlin, Wis., 53151, phone number 1-800-877-8351, and at their web site: http://www.jwwinco.com. The exact model and part number may vary depending on shoe size and shape in which it is to be used, but may be determined by those of skill in the art and to whom this specification is directed.

In an embodiment, a quick disconnect latch 72 may be provided as a hand retractable spring plunger wherein a spring (not shown) biases the locking pin to a normally extended, locking position 82 as noted in FIG. 7. In an embodiment, as seen in FIG. 7 or 8, an L-shaped handle 92 may be provided, with a lock out slot 94 for caging the handle 92 when the quick disconnect latch 72 is in a locking pin 80 extended locking position 82. In an embodiment, the handle 92 may be oriented at substantially ninety (90) degrees from the axis 74 of the locking pin 80. In an embodiment, locking pin 80 may be provided in a generally cylindrical configuration.

As seen in FIG. 13, in an embodiment, a first heel 40 of height $H_1$ may be provided, wherein the height $H_1$ is sized to position a heel of a user (not shown) at a first predetermined elevation above ground 96, wherein the first predetermined elevation provides a relatively high heel configuration for the first heel 40. The first locking slide portion 48 of first heel 40 further comprises a first nose piece 100, with a first detent 102 therein. In an embodiment, the first nose piece 100 may be provided in a partial parallelepiped shaped protrusion from the first heel 40. As used herein, the term "partial parallelepiped" shape denotes that the first nose piece 100 may be provided where edges of five of six sides are shaped as parallelograms. The locking pin 80 is sized and shaped for locking engagement between the locking pin 80 and the first detent 102.

As seen in FIG. 14, in an embodiment, a second heel 50 of height $H_2$ may be provided, wherein height $H_2$ is sized to position a heel of a user (not shown) at a second predetermined elevation above ground 96, wherein the second predetermined elevation provides a medium height heel configuration for the second heel 50. The second locking slide portion 58 of second heel 50 further comprises a second nose piece 104, with a second detent 106 therein. As used herein, the term "partial parallelepiped" shape denotes that the second nose piece 104 may be provided where edges of five of six sides are shaped as parallelograms. The locking pin 80 is sized and shaped for locking engagement between the locking pin 80 and the second detent 106.

As seen in FIG. 15, in an embodiment, a third heel 60 of height $H_3$ may be provided, wherein height $H_3$ is sized to position a heel of a user (not shown) at a third predetermined elevation above ground 96, wherein the third predetermined elevation provides a low height heel configuration for the third heel 60. The third locking slide portion 68 of the third heel 60 further comprises a third nose piece 108, with a third detent 110 therein. As used herein, the term "partial parallelepiped" shape denotes that the third nose piece 108 may be provided where edges of five of six sides are shaped as parallelograms. The locking pin 80 is sized and shaped for locking engagement between the locking pin 80 and the third detent 110.

As seen from FIGS. 5 and 6, the heel attachment slide capture feature 28 in the sole 22 further comprises a nose piece receiving dock 120 defined by interior sidewalls 122. The nose piece receiving dock 120 is sized and shaped for complementary mating engagement with the first nose piece 100, or with the second nose piece 104, or with the third nose piece 108.

Figure 9:
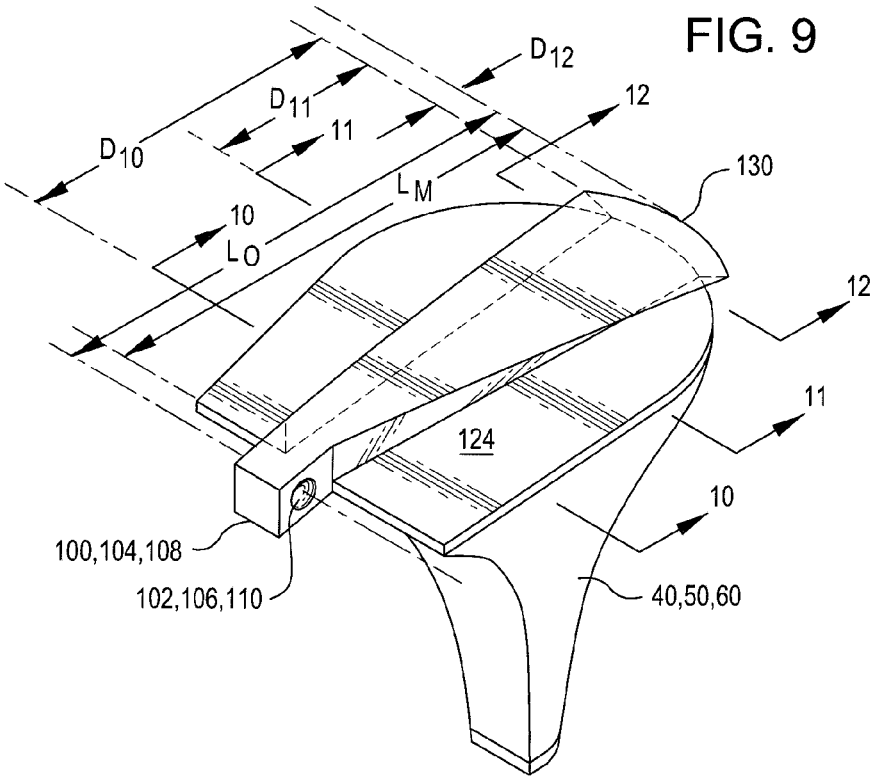
FIG. 9 provides a perspective view of a heel of selected height H, illustrating an embodiment wherein the locking slide portion is sized and shaped for complementary locking engagement with a slide capture feature on a sole for secure engagement therewith, and also showing how the width of the locking slide portion decreases from said heel end toward said toe end; an embodiment for a nose piece with detent for accepting a locking pin of a quick release latch is also shown.

In various embodiments, any one or more of the first heel 40, second heel 50, and third heel 60 may include a mating plate 124 as seen in FIG. 9, and wherein the mating plate 124 has a length $L_M$. In any event, as also seen in FIG. 9, the a locking slide portion 48, 58, or 68 (such as the first locking slide portion 48 of first heel 40), has an overall length $L_O$.

Figure 10:
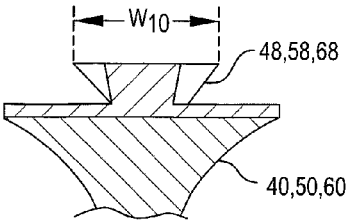
FIG. 10 provides a cross-sectional view, taken across line 10-10 of FIG. 9, showing the width $W_{10}$ of a locking slide portion on the heel, at a distance $D_{10}$ from the heel rear end.

Attention is directed to FIGS. 9 and 10, wherein FIG. 10 provides a cross-sectional view, taken across line 10-10 of FIG. 9, showing the width $W_{10}$ of a locking slide portion (48, 58, or 68) on a heel (40, 50, or 60), at a distance $D_{10}$ from the heel rear end 130.

Figure 11:
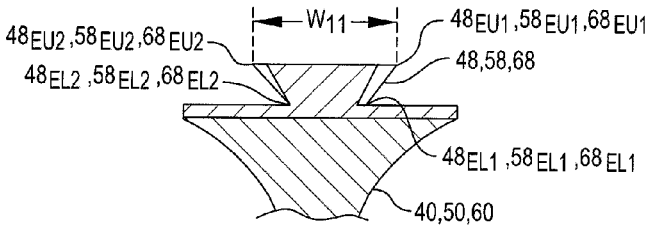
FIG. 11 provides a cross-sectional view, taken across line 11-11 of FIG. 9, showing the width $W_{11}$ of a locking slide portion on the heel, at a distance $D_{11}$ from the heel rear end.

Attention is directed to FIG. 9 and FIG. 11, wherein FIG. 11 provides a cross-sectional view, taken across line 11-11 of FIG. 9, showing the width $W_{11}$ of a locking slide portion (48, 58, or 68) on a heel (40, 50, or 60), at a distance $D_{11}$ from the heel rear end 130.

Figure 12:
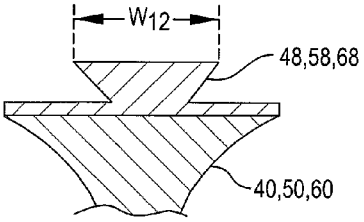
FIG. 12 provides a cross-sectional view, taken across line 12-12 of FIG. 9, showing the width $W_{12}$ of a locking slide portion on the heel, at a distance $D_{12}$ from, but very near to, the heel rear end.

Attention is further directed to FIG. 9 and FIG. 12, wherein FIG. 12 provides a cross-sectional view, taken across line 12-12 of FIG. 9, showing the width $W_{12}$ of a locking slide portion (48, 58, or 68) on a heel (40, 50, or 60), at a distance $D_{12}$ from, but very near to, the heel rear end 130.

As shown herein in an embodiment, shoes may be provided wherein interlocking dove tail joint portions are inserted and removed from sole 22 at the rear, that is, from the heel end 26 of sole 22. In any event, first heel 40, second heel 50, or third heel 60 are releaseably affixed to the sole 22. In various embodiments, a quick release latch may be used, and in various embodiments, such a quick disconnect latch 72 release may be accessible from the inner side of a sole 22.

In so far as is presently known the shoes with interchangeable heels as disclosed is a distinct improvement in the art of shoes with interchangeable heels. In an embodiment, a quick release latch may be utilized that allows unlocking and detachment of a heel on a "one-handed" basis, which makes change out of heels, such as to provide a shoe with a different heel height, extremely easy, and inconspicuous, regardless of business or social setting of the user.

In the foregoing description, for purposes of explanation, numerous details have been set forth in order to provide a thorough understanding of the disclosed exemplary embodiments for the design of a shoe with interchangeable heels. However, certain of the described details may not be required in order to provide useful embodiments, or to practice a selected or other disclosed embodiments. Further, for descriptive purposes, various relative terms may be used. Terms that are relative only to a point of reference are not meant to be interpreted as absolute limitations, but are instead included in the foregoing description to facilitate understanding of the various aspects of the disclosed embodiments. And, various actions or activities in any method described herein may have been described as multiple discrete activities, in turn, in a manner that is most helpful in understanding the developments described herein. However, the order of description should not be construed as to imply that such activities are necessarily order dependent. In particular, certain operations may not necessarily need to be performed precisely in the order of presentation. And, in different embodiments of the invention, one or more activities may be performed simultaneously, or eliminated in part or in whole while other activities may be added. Also, the reader will note that the phrase "in an embodiment" or "in one embodiment" has been used repeatedly. This phrase generally does not refer to the same embodiment; however, it may. Finally, the terms "comprising", "having" and "including" should be considered synonymous, unless the context dictates otherwise.

From the foregoing, it can be understood by persons skilled in the art that a novel design for shoes with interchangeable heels has been described herein. Although only certain specific embodiments of the developments presented herein have been shown and described, there is no intent to limit such developments to the specifically described embodiments. Rather, the developments are to be defined by the appended claims and their equivalents when taken in combination with the description.

Importantly, the aspects and embodiments described and claimed herein may be modified from those shown without materially departing from the novel teachings and advantages provided, and may be embodied in other specific forms without departing from the spirit or essential characteristics thereof. Therefore, the embodiments presented herein are to be considered in all respects as illustrative and not restrictive or limiting. As such, this disclosure is intended to cover the structures described herein and not only structural equivalents thereof, but also equivalent structures. Numerous modifications and variations are possible in light of the above teachings. Therefore, the protection afforded should be limited only by the claims set forth herein, and the legal equivalents thereof.

The invention claimed is:

1. An interchangeable shoe assembly, comprising:

a sole, said sole having a toe end and a heel end, and located at said heel end, a heel attachment slide capture feature, said heel attachment slide capture feature further comprising opposing first and second wedge portions forming a partial V-shaped passageway therebetween, said partial V-shaped passageway at least in part decreasing in width W from said heel end toward said toe end;

an upper foot engaging portion;

a first heel, said first heel comprising a first heel body having a first upper end and a first lower end, a first ground engaging surface located at said first lower end, and a first locking slide portion sized and shaped complementary to said heel attachment slide capture feature for secure engagement therewith;

a second heel, said second heel comprising a second heel body having a second upper end and a second lower end, a second ground engaging surface located at said second lower end, and a second locking slide portion sized and shaped complementary to said heel attachment slide capture feature for secure engagement therewith;

a quick disconnect latch that provides releasable locking engagement between said sole and said first heel or said second heel; and wherein said sole has a longitudinal axis between said heel end and said toe end, and wherein said quick disconnect latch moves transverse to said longitudinal axis to engage and disengage said quick disconnect latch; and wherein said quick disconnect latch comprises a locking pin, and wherein said first heel further comprises a first detent, and wherein said locking pin is sized and shaped for locking engagement between said locking pin and said first detent.

2. The interchangeable shoe assembly as set forth in claim 1, wherein said heel attachment slide capture feature on said sole comprises a base sliding dove tail joint portion.

3. The interchangeable shoe assembly as set forth in claim 2, further comprising a third heel, said third heel comprising a third heel body having a third upper end and a third lower end, a third ground engaging surface located at said third lower end, and a third locking slide portion sized and shaped complementary to said heel attachment slide capture feature for secure engagement therewith.

4. The interchangeable shoe assembly as set forth in claim 3, wherein said quick disconnect latch provides releasable locking engagement between said sole and said third heel.

5. The interchangeable shoe assembly as set forth in claim 3, wherein said first locking slide portion comprises a first sliding dove tail joint portion.

6. The interchangeable shoe assembly as set forth in claim 5, wherein said second locking slide portion comprises a second sliding dove tail joint portion.

7. The interchangeable shoe assembly as set forth in claim 6, wherein said third locking slide portion comprises a third sliding dove tail joint portion.

8. The interchangeable shoe assembly as set forth in claim 3, wherein said second heel further comprises a second detent, and wherein said third heel further comprises a third detent, and wherein said locking pin is sized and shaped for locking engagement between said locking pin and said third detent.

9. The interchangeable shoe assembly as set forth in claim 8, wherein said quick disconnect latch comprises a handle, and wherein said handle is oriented at substantially ninety (90) degrees from said locking pin.

10. The interchangeable shoe assembly as set forth in claim 8, wherein said locking pin is cylindrical.

11. The interchangeable shoe assembly as set forth in claim 10, wherein said first locking slide portion has an overall length $L_O$.

12. The interchangeable shoe assembly as set forth in claim 3, wherein said first heel comprises a heel of height $H_1$, said height $H_1$ sized at a first predetermined elevation above ground, wherein said first predetermined elevation provides a high heel configuration for said first heel.

13. The interchangeable shoe assembly as set forth in claim 12, wherein said second heel comprises a heel of height $H_2$, said height $H_2$ sized at a second predetermined elevation above ground, wherein said second predetermined elevation provides a medium height heel configuration for said second heel.

14. The interchangeable shoe assembly as set forth in claim 13, wherein said third heel comprises a heel of height $H_3$, said height $H_3$ sized at a third predetermined elevation above ground, wherein said third predetermined elevation provides a low height heel configuration for said third heel.

15. The interchangeable shoe assembly as set forth in claim 1, wherein at least one of said opposing first and second wedge portions is oriented substantially parallel to said longitudinal axis.

16. The interchangeable shoe assembly as set forth in claim 1, wherein said second heel further comprises a second detent, and wherein said locking pin is sized and shaped for locking engagement between said locking pin and said second detent.

17. The interchangeable shoe assembly as set forth in claim 16, wherein said locking pin is cylindrical.

18. The interchangeable shoe assembly as set forth in claim 17, wherein said locking pin is normally biased in an outward, locking position.

19. The interchangeable shoe assembly as set forth in claim 1, wherein said quick disconnect latch comprises a hand retractable spring plunger.

20. The interchangeable shoe assembly as set forth in claim 1, wherein said first locking slide portion of said first heel further comprises a first nose piece, and wherein said heel attachment slide capture feature in said sole further comprises a nose piece receiving dock defined by interior sidewalls, and wherein said nose piece receiving dock is sized and shaped for complementary mating engagement with said first nose piece.

21. The interchangeable shoe assembly as set forth in claim 20, wherein said first nose piece comprises a partial parallelepiped shaped protrusion from said first heel.

22. The interchangeable shoe assembly as set forth in claim 20, wherein said first nose piece further comprises said first detent, and wherein said first detent is sized and shaped for locking engagement with said locking pin.

23. The interchangeable shoe assembly as set forth in claim 22, wherein said second locking slide portion of said second heel further comprises a second nose piece, and wherein said nose piece receiving dock is sized and shaped for complementary mating engagement with said second nose piece.

24. The interchangeable shoe assembly as set forth in claim 23, wherein said second nose piece comprises a partial parallelepiped shaped protrusion from said second heel.

25. The interchangeable shoe assembly as set forth in claim 23, wherein said second nose piece further comprises a second detent, and wherein said second detent is sized and shaped for locking engagement with said locking pin.

26. The interchangeable shoe assembly as set forth in claim 25, further comprising a third heel having a third locking slide portion and wherein said third heel further comprises a third nose piece, and wherein said nose piece receiving dock is sized and shaped for complementary mating engagement with said third nose piece.

27. The interchangeable shoe assembly as set forth in claim 26, wherein said third nose piece comprises a partial parallelepiped shaped protrusion from said third heel.

28. The interchangeable shoe assembly as set forth in claim 26, wherein said third nose piece further comprises a third detent, and wherein said third detent is sized and shaped for locking engagement with said locking pin.

29. The interchangeable shoe assembly as set forth in claim 1, wherein said locking pin is cylindrical.

30. The interchangeable shoe assembly as set forth in claim 1, wherein said first heel further comprises a mating plate, and wherein said mating plate has a length $L_M$.

* * * * *